US005673498A

United States Patent [19]

Amir et al.

[11] Patent Number: 5,673,498

[45] Date of Patent: Oct. 7, 1997

[54] SHOCK ABSORBING SYSTEM FOR HUMAN FEET

[76] Inventors: Avni Amir, Mishol Moran 28/3, Kurmiel; Menahem Hartman, Dgania Str #35, Kiriat-Haim, both of Israel; Shalom Ohayon, 2305 60th St., Brooklyn, N.Y. 11204, now by change of name from Shalom Ochayon

[21] Appl. No.: 533,526

[22] Filed: Feb. 27, 1995

[51] Int. Cl.[6] ..... A43B 13/20

[52] U.S. Cl. ..... 36/29; 36/28

[58] Field of Search ..... 36/28, 29, 35 B

[56] References Cited

U.S. PATENT DOCUMENTS

| | | | |
|---|---|---|---|
| 4,358,902 | 11/1982 | Cole et al. | 36/29 X |
| 4,446,634 | 5/1984 | Johnson et al. | 36/29 |
| 4,458,430 | 7/1984 | Peterson | 36/29 X |
| 4,577,417 | 3/1986 | Cole | 36/29 |
| 4,774,774 | 10/1988 | Allen, Jr. | 36/29 X |
| 4,779,359 | 10/1988 | Famolare, Jr. | 36/29 |
| 4,860,463 | 8/1989 | Pin | 36/29 X |
| 4,864,737 | 9/1989 | Marrello | 36/28 X |
| 4,999,931 | 3/1991 | Vermeulen | 36/30 R X |

FOREIGN PATENT DOCUMENTS

| | | | |
|---|---|---|---|
| 1287477 | 1/1969 | Germany | 36/29 |
| 0385060 | 12/1932 | United Kingdom | 36/29 |

*Primary Examiner*—Ted Kavanaugh

[57] ABSTRACT

A shock absorbing mid sole component in human footwear is disclosed and which constructed from an upper half, containing two cavities that act as a gas chamber, a lower half, containing two interconnected cavities designed so, a calibrated transfer of liquid can be achieved by manually turning screw, an elastomeric bladder portion in the inside of the shoe sole that is designed to carry the shock absorbing liquid between the bladders in a regulated selectable rate.

1 Claim, 2 Drawing Sheets

SHOCK ABSORBING SYSTEM FOR HUMAN FEET

FIELD OFF THE INVENTION

This invention relates to a shock absorbing system for human footwear.

BACKGROUND OF THE INVENTION

Our bi pedal evolution, from Homo erectus to Sapiens, attached certain discomforts to walking upright on two legs. Since then, humans have always looked for ways to minimize the effects of bipedal life by designing and improving upon different shape and styles of shoes.

Our health is greatly affected by improper footwear, especially in the knee area and the lower back.

Sport and exercise activities involving footwear with insufficient shock absorbing often leads to injuries, accidents and related stresses and hardships.

In order to solve these health problems, many solutions have been attempted, such as orthopedic shoes, elastic shoes and other many types of rubber or foam inserts. Although these are clearly improvements to a certain extent, there is still a large demand for much grater improvements in this field of innovation.

SUMMARY OF THE INVENTION

The object of the invention is to provide a means of shock absorbing of energy to the foot and thereby reducing the transfer of stress to the upper parts of the body such as the knees, joints, spine etc. During impact of the foot with the ground or other hard surfaces, especially when running. The invention asserts that a split shoe sole acts as a shock absorber similar to those found in car bumpers, car struts and airplane landing gear.

The split shoe sole comprises:

1—An upper half of the sole with two cavities acting as gas chambers.

2—A lower half of the sole with two interconnected cavities with a means for a calibrated liquid transfer.

3—A layer of elastic material acting as a diaphragm between the two sole halves.

BRIEF DESCRIPTION OF THE DRAWINGS

The invention will be described herewith, in way of example, by reference to the accompanying drawings as follows.

DETAILED DESCRIPTION OF THE PREFERRED EMBODIMENT

Figure 1:
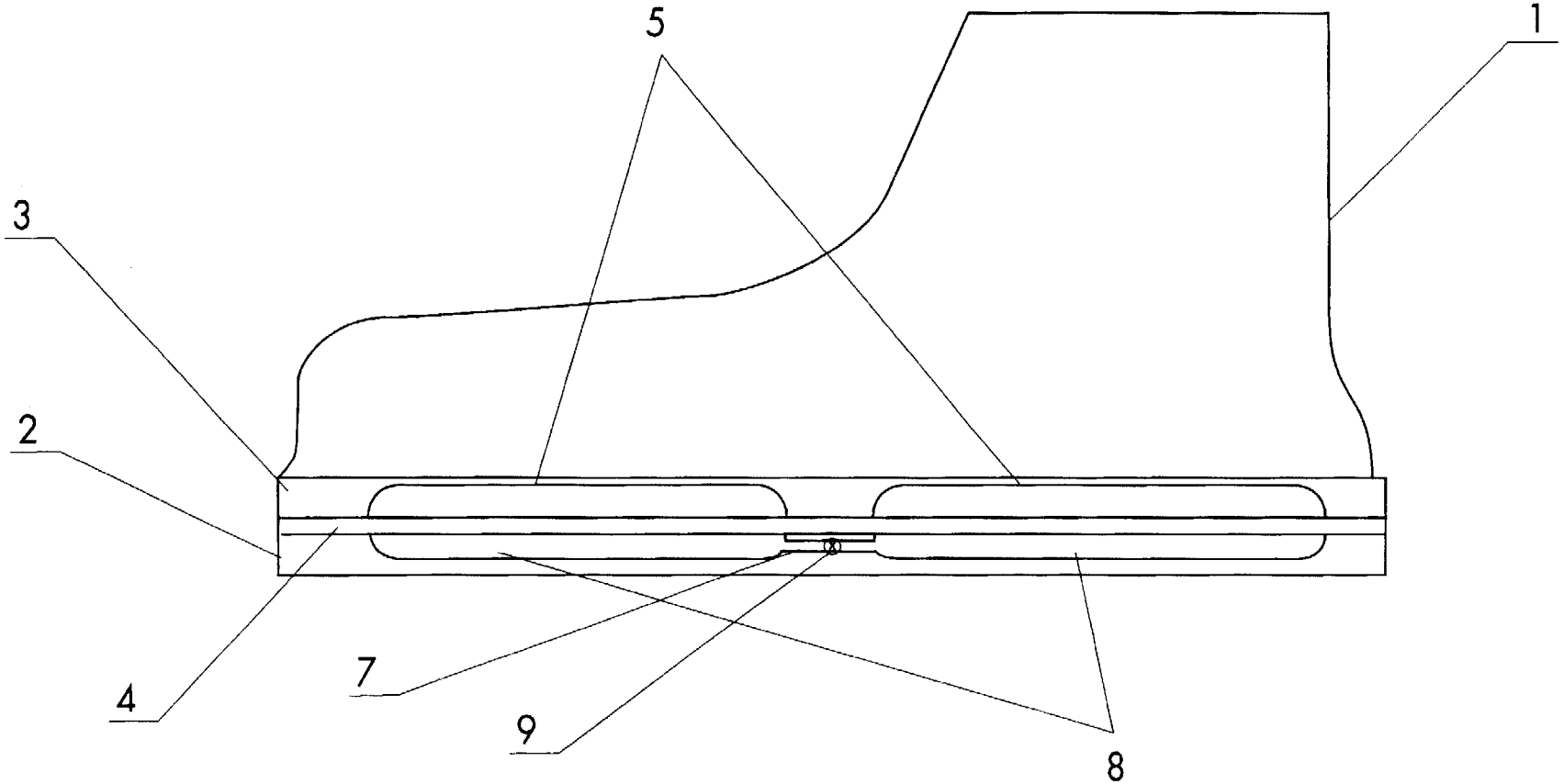
FIG. 1.—1 is a sectioned shoe, with emphasis on its split sole, 2 is the lower half and 3 is the upper half, and the two halves are divided by elastic layer 4, above the elastic layer there is two cavities 5, which used as a gas chamber, under the elastic layer 4, which is sole lower half that is made of two cavities 8, and which are interconnected through a channel 7, for liquid transfer regulated by screw 9.
Figure 2:
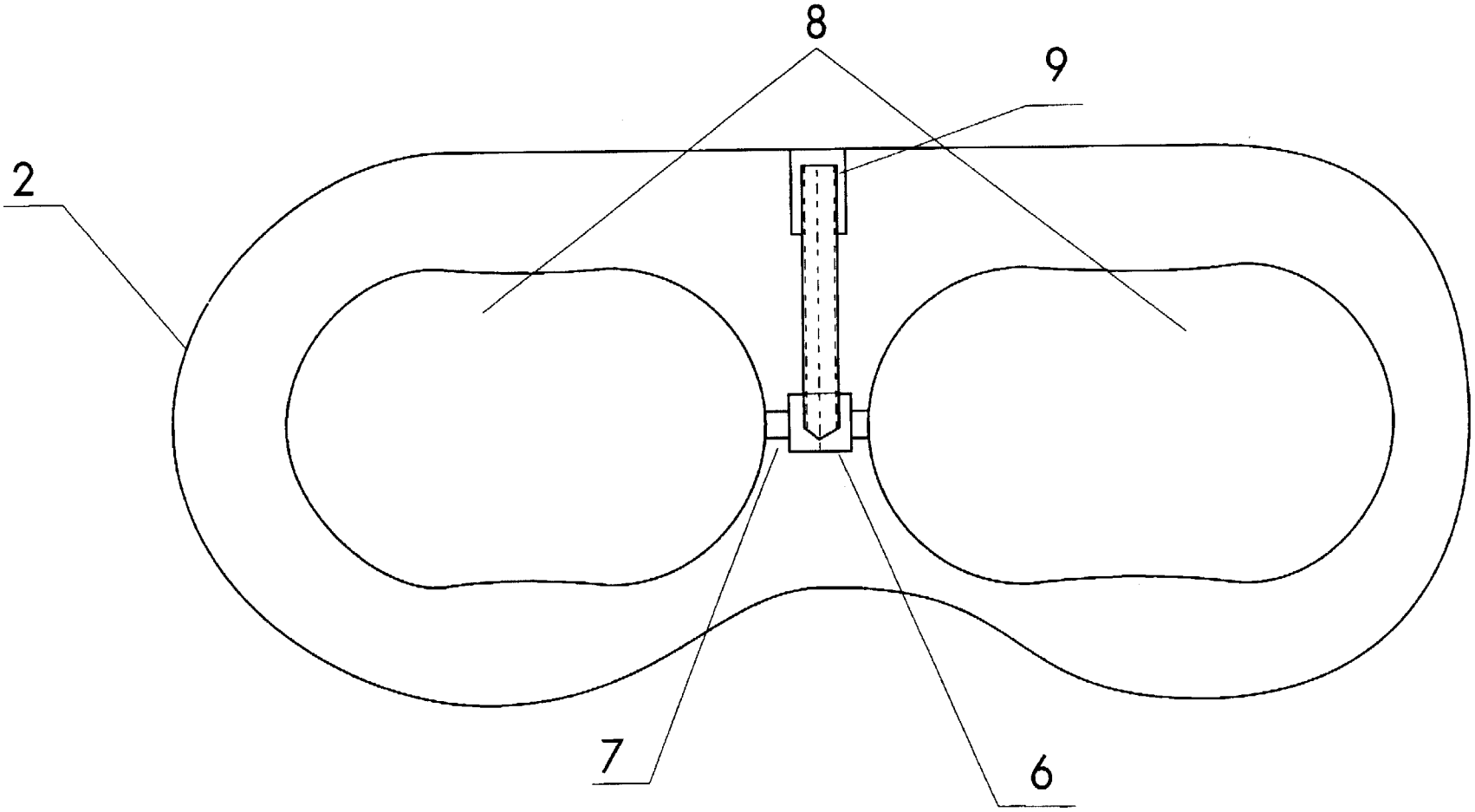
FIG. 2 is a partially sectioned upper view of the lower half of the shoe sole 2, with the two cavities 8, which are interconnected through channel 7, the screw 9 is for regulating the flow of liquid in the valve 6, between the cavities 8.

According to the invention, the shock absorbing operation is as follows: When a step is made the heel of the shoe sole is first touches the ground, the pressure built causes the rear part of the sole to compress and the liquid from the lower sole's half rear cavity is transferred to the front cavity via the restructor valve 6, whereby, the bigger amount of liquid volume compresses the air in the front cavity of the upper half sole 3, via the elastic layer 4, that acts as a diaphragm. this action absorbs the heel impact energy when it contacts the ground. The same principle of absorbing impact energy, occurs in reverse direction when the front of the shoe sole touches the ground.

We claim:

1. A Shock absorbing sole for footwear comprising:

an upper half sole, a lower half sole and an elastic layer positioned between the half soles, the elastic layer having an upper surface and a lower surface;

the upper half sole and the upper surface of the elastic layer forming two cavities therebetweem, said cavities contain a gas;

the lower half sole and the lower surface of the elastic layer forming two cavities therebetween which are interconnected through a channel to permit liquid transfer between the two cavities formed in the lower half sole, said cavities in the lower half sole contain a liquid;

the channel having a valve and a screw therein, wherein the flow of liquid is regulated between the cavities of the lower half sole by manually turning the screw to regulate the valve; whereby the elastic layer between the cavities of the upper and lower half soles acts as a diaphragm to absorb impact energy when the sole contacts the ground.

* * * * *